US005826625A

United States Patent [19]

Bucher

[11] Patent Number: 5,826,625

[45] Date of Patent: Oct. 27, 1998

[54] HEALD FRAME LINEAR DRIVE ARRANGEMENT

[75] Inventor: Robert Bucher, Frick, Switzerland

[73] Assignee: Sulzer Rueti AG, Rueti, Switzerland

[21] Appl. No.: 840,828

[22] Filed: Apr. 16, 1997

[30] Foreign Application Priority Data

Aug. 23, 1996 [EP] European Pat. Off. ..... 96810560

[51] Int. Cl.[6] ..... D03C 5/00; D03C 13/00

[52] U.S. Cl. ..... 139/55.1; 139/455; 139/456

[58] Field of Search ..... 139/55.1, 455, 139/456

[56] References Cited

U.S. PATENT DOCUMENTS 3,074,438 1/1963 Svaty .
4,195,671 4/1980 Bossut ..... 139/455
5,069,256 12/1991 Goodman .
5,355,911 10/1994 Kuster et al. ..... 139/55.1
5,462,097 10/1995 Skalka ..... 139/455
5,464,046 11/1995 Mcintyre et al. ..... 139/455

FOREIGN PATENT DOCUMENTS 2 310 229 10/1974 Germany .

*Primary Examiner*—Andy Falik
*Attorney, Agent, or Firm*—Townsend and Townsend and Crew LLP

[57] ABSTRACT

An arrangement comprises heald frames, linear drives and coupling apparatus that are collected together in groups. The linear drives of each group are arranged in a staggered fashion and form a drive unit. The coupling apparatus are executed in such a manner that the staggering within a group can be selected. With this arrangement an ideal ratio of drive power to required space is achieved. In addition, the elements forming a group are interchangeable.

14 Claims, 5 Drawing Sheets

HEALD FRAME LINEAR DRIVE ARRANGEMENT

BACKGROUND OF THE INVENTION

Field of the Invention

The present invention relates to an arrangement for the formation of a shed for use with a weaving machine and to a weaving machine with the arrangement.

SUMMARY OF THE INVENTION

The present invention provides an arrangement for the formation of a shed in which an ideal ratio of the required drive power to the required space is achieved, based upon the number of heald frames, through the formation of groups with the drives and the coupling means.

An advantage of the invention is the fact that the heald frames, the coupling means and the drive units can be standardized. The staggering of the first and the second linear motors can be matched to the requirements for an ideal ratio of the required drive power to the required space.

DETAILED DESCRIPTION OF THE PREFERRED EXEMPLARY EMBODIMENTS

Figure 4:
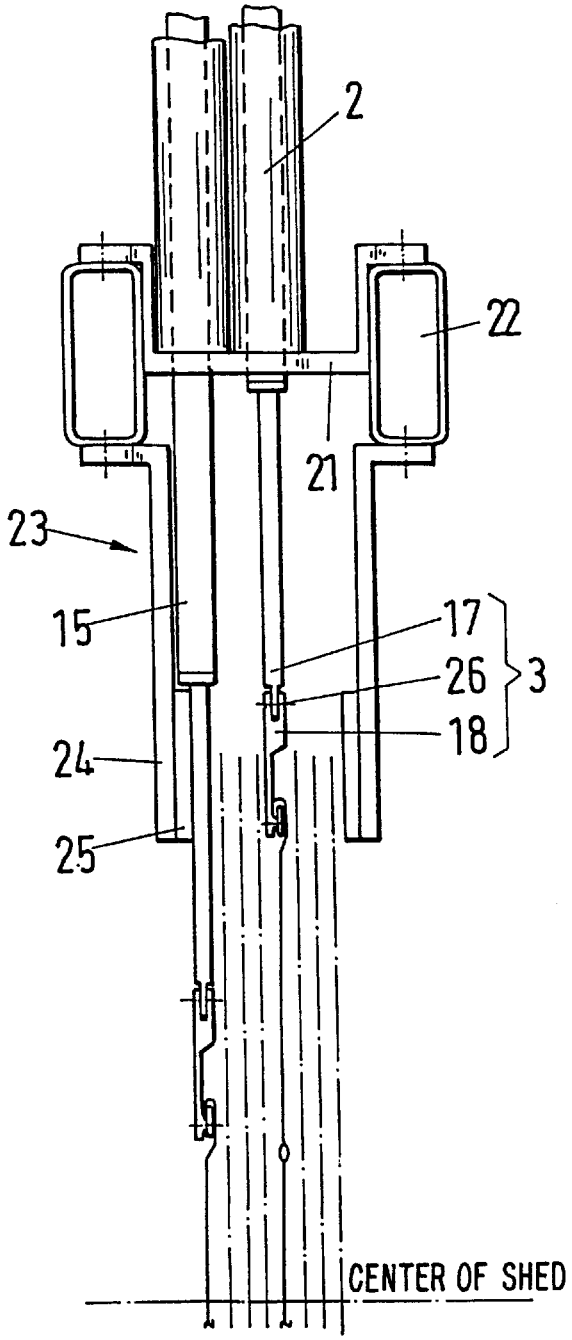
FIG. 4 is an elevation view in the direction of arrow C in FIG. 1.
Figure 5:
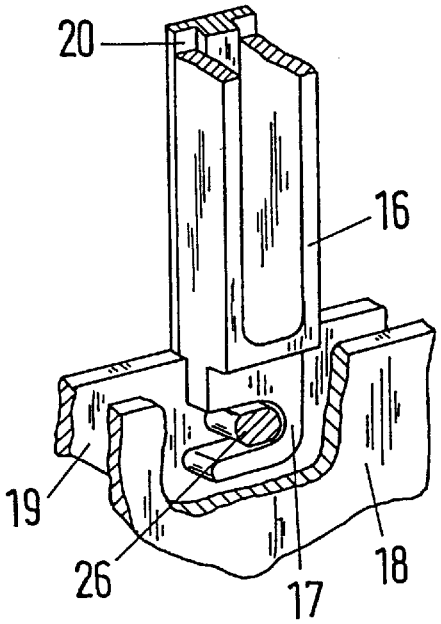
FIG. 5 is a perspective view of an embodiment of a drive rod with horizontal coupling movement.
Figure 6:
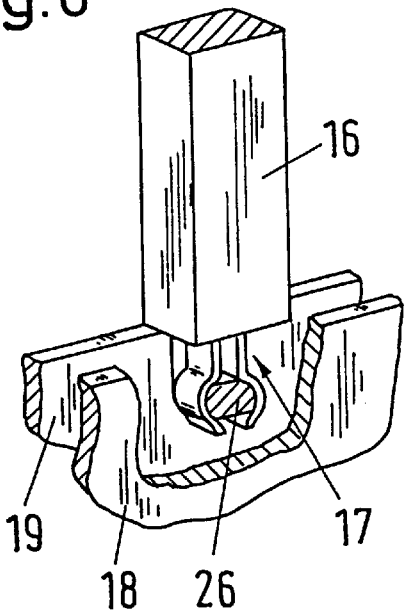
FIG. 6 is a perspective view of an embodiment of a drive rod with vertical coupling movement.

Reference is made to FIGS. 1 to 5. An arrangement includes heald frames 1, electronically controlled electrical linear drives 2 and coupling means 3. The heald frames 1 are collected into groups, with four heald frames 1 in each case forming a group 4. Drive units 5, 6, which are mounted in fixed spatial positions above and below the heald frames 1, each comprise two groups 7 of four linear drives 2 and are associated with each heald frame group 4. Furthermore, two groups 8 of coupling means 3, which connect the heald frames 1 to the linear drives 2, are respectively associated with each heald frame group 4. The connection by the coupling means 3 is executed in such a manner that the heald frames 1 are held and/or guided without play in the direction of movement, with the healds being held at the heald slide bars with play in a known manner. The heald frames 1 consist essentially of two heald slide bars 11 between which a plurality of healds 12 with heald eyes 13 are arranged. The heald slide bar is of known design. The linear drives have an armature part 15 and are already known per se, so that a detailed description will be omitted. The linear drives 2 of each group are arranged in a staggered fashion transversely to the longitudinal extent of the heald frames 1. The coupling means 3 comprise drive rods 16 which are connected at one end to the armature parts 15 of the linear drives 2 and have at the other end a receiving section 17, holders 18, which are secured to the heald slide bars 2, and pins 26 into which the drive rods 16 can be hung (FIGS. 5, 6). The holder 18 has a U-shaped section 19 at one longitudinal side in which four pins 26 are arranged and a section 20 on which the heald slide bar 2 is secured.

In a known manner, either a vertical and horizontal movement (FIG. 5) or merely a vertical movement (FIG. 6) is performed for the coupling of the heald frames to the drive rods. For these reasons the receiving section 4 is made hook-shaped or clamping members are provided. During the weaving it can happen that a lesser number of or only one of the heald frames is moved. In order to guide the heald frame relative to the adjacent heald frames, a guide strip 20 is provided on at least one side (FIG. 5) or the drive rod is dimensioned in such a manner that the surfaces of the drive rods near the heald frames of the group form guide surfaces.

Figure 1:
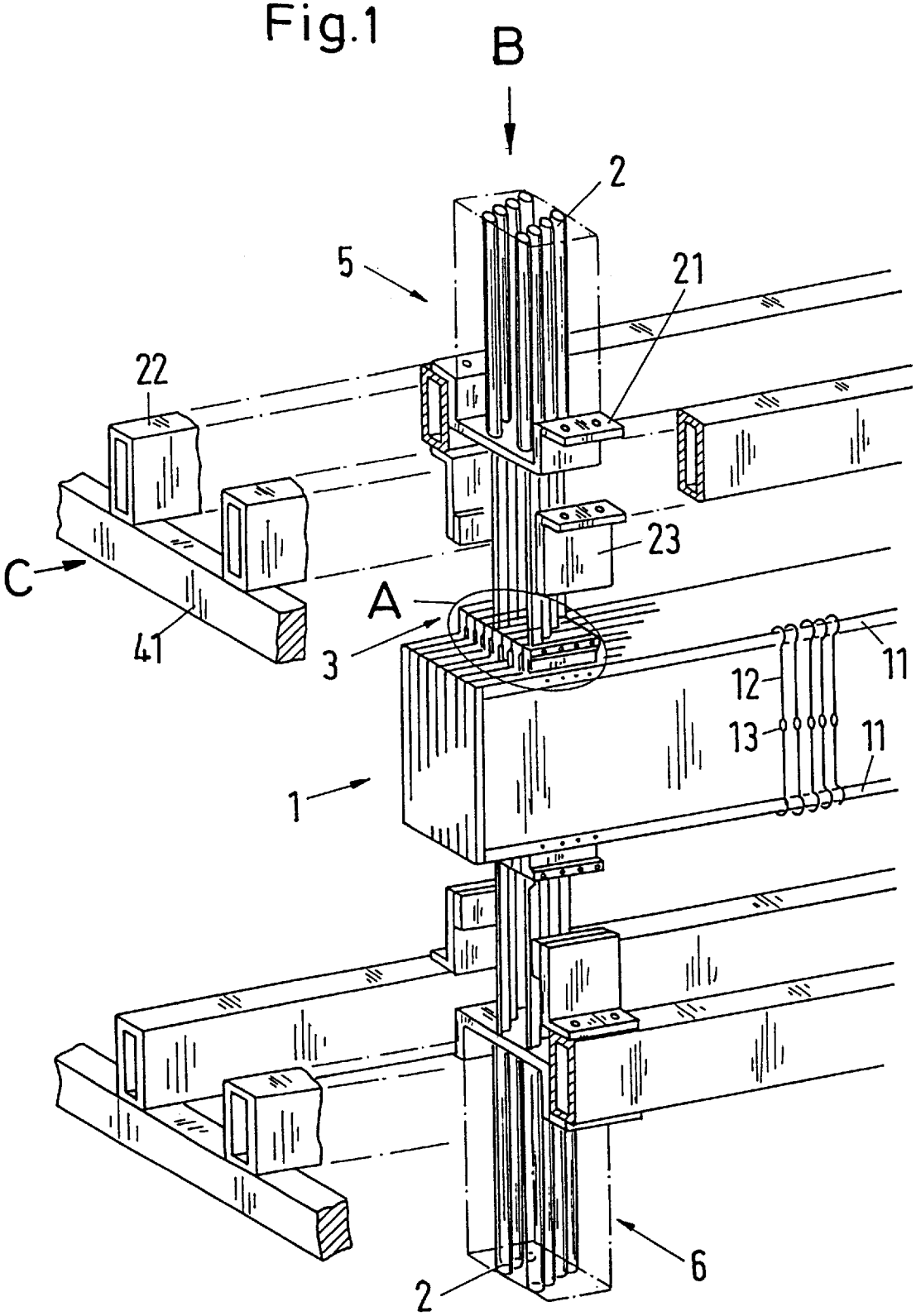
FIG. 1 is a perspective view of an embodiment of an arrangement in accordance with the present invention.

As shown in FIG. 1, the groups 5, 6 of linear drives 2 are mounted on a bracket-like holding member 21 which is secured to two transverse beams 22. The holding member 21 relatively spaces apart the linear drives 2 on the one hand and the transverse beams 22 on the other hand. Guides 23 for the drive rods 11 of the frontmost and rearmost heald frames of a group of heald frames are provided at the transverse beams 22 in the region of the linear drives 2. The guides 23 are secured at the transverse beams 22 and each consists of an angled section 24 and a guide plate 25 (FIG. 4).

Figure 1A:
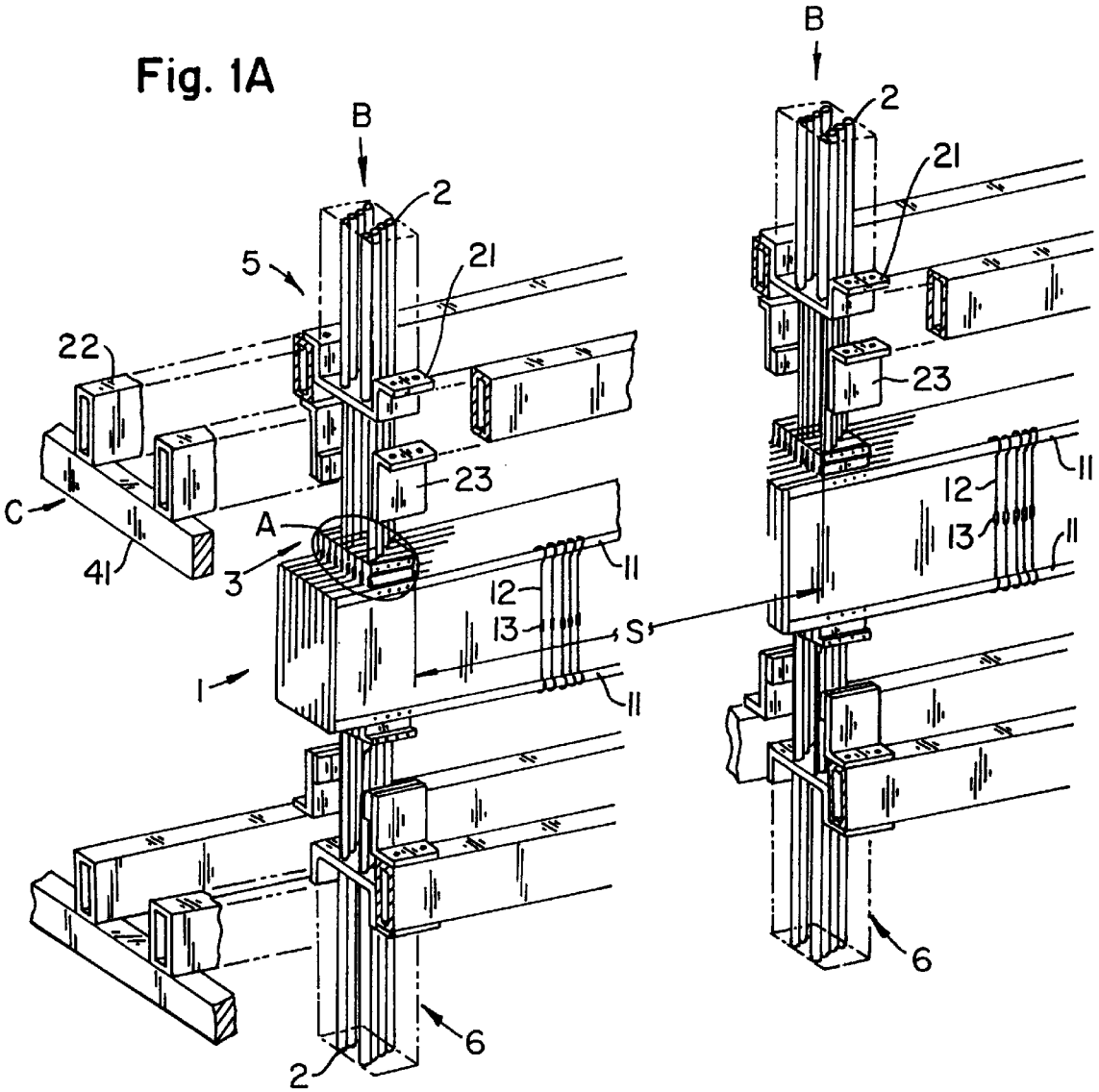
FIG. 1A is a perspective view of two arrangements illustrated in FIG. 1 and their spatial relationship.
Figure 2:
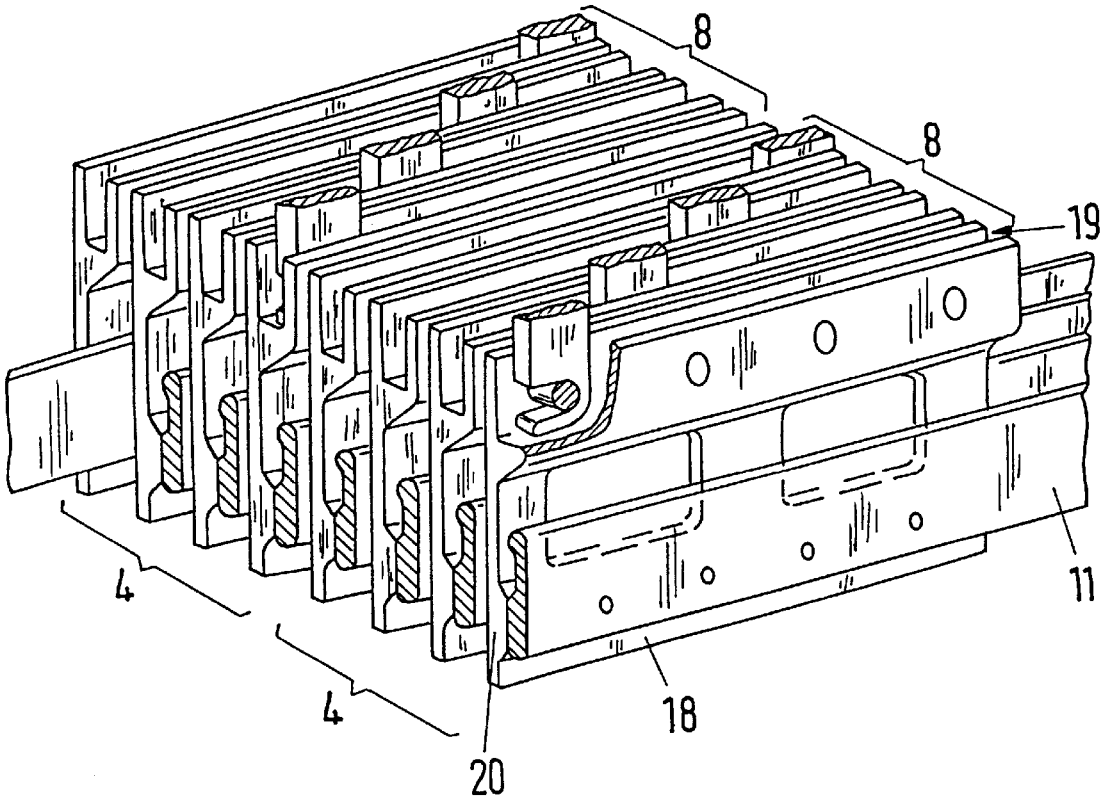
FIG. 2 is an enlarged perspective view of detail A in FIG. 1.
Figure 3:
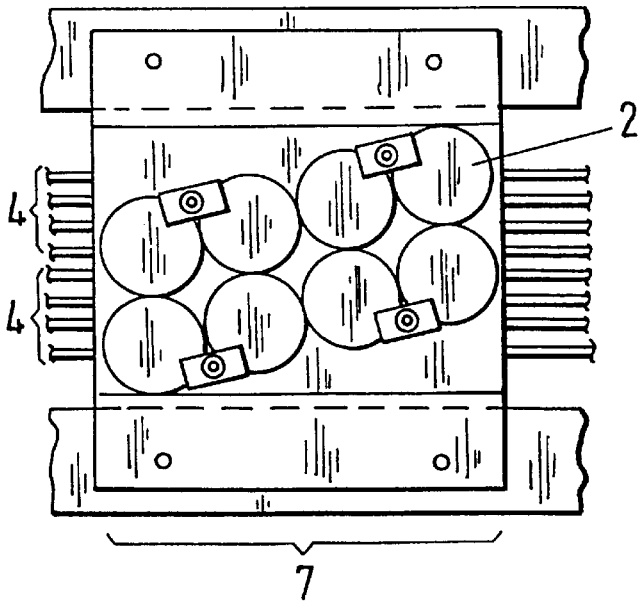
FIG. 3 is a plan view in the direction of arrow B in FIG. 1.

As already mentioned, the drive units 5, 6 are mounted on the transverse beams 22 and hold the heald frames 1 in an initial position in which the heald eyes 13 lie in a plane. A plurality of drive units 5, 6 are provided which are arranged distributed over the length of the heald slide bar 14. The spacings along the length of the heald slide bar, illustrated in FIG. 1A, can lie in the range from 0.20 m to 1.00 m, in particular in the range from 0.40 m to 0.60 m.

Figure 7:
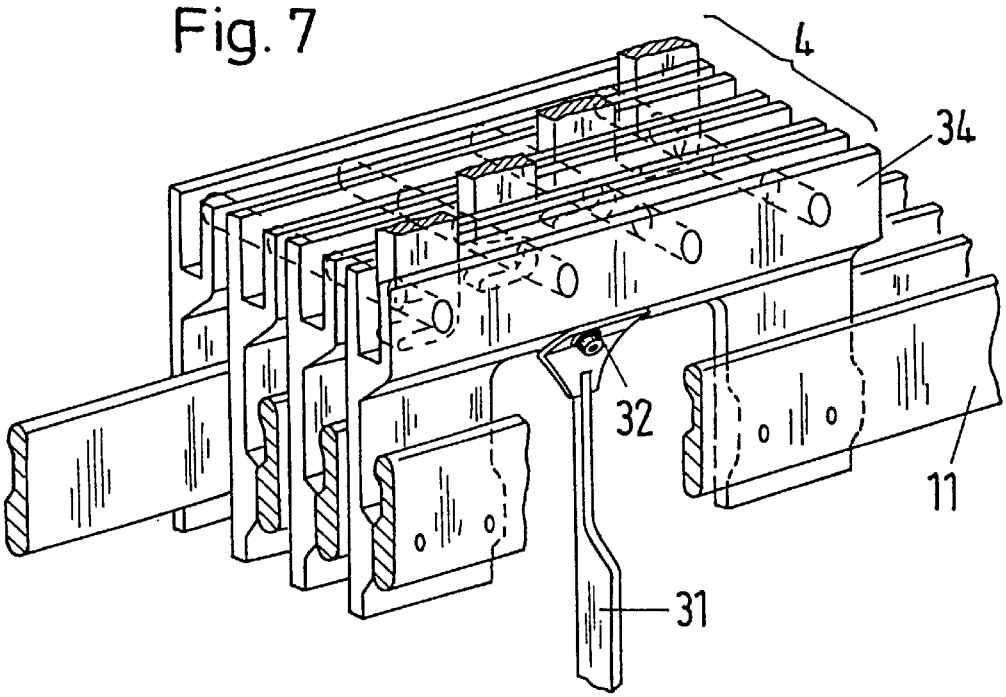
FIG. 7 is a perspective view of a mounting of a strut which is arranged between the heald slide bars.
Figure 8:
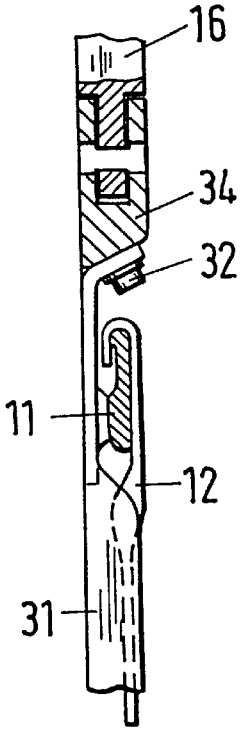
FIG. 8 is a section view through the mounting of the strut in FIG. 7.
Figure 9:
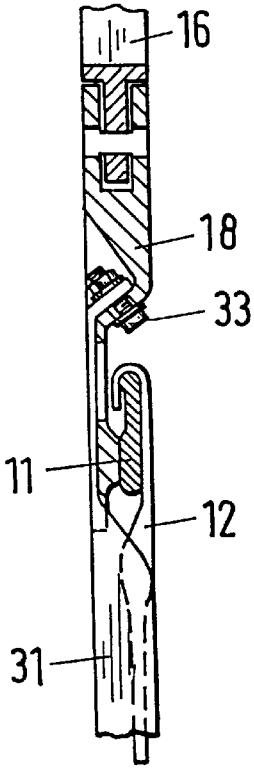
FIG. 9 is a section view through an alternative embodiment of the mounting of a strut.

Struts 31 are provided (FIGS. 7 to 9) in order to lend added stability to the heald frame 1. The latter has the advantage that both linear drives 2 can be designed for a lower power. The strut 31 is centrally secured at the holders 18, 34 by means of screws 32, 33 (FIGS. 8 and 9).

Thus, the arrangement includes heald frames 1, linear drives 2 and coupling means 3 which are collected together in groups. As can be seen in FIG. 1, the linear drives 3 of each group 8 are arranged in a staggered fashion and form a drive unit. The coupling means are executed in such a manner that the staggering within a group can be selected. With this arrangement an ideal ratio of drive power to required space and a standardization of the elements forming a group are achieved.

What is claimed is:

1. An arrangement for the formation of a shed, the arrangement comprising heald frames which are arranged parallel to and spaced with respect to one another and which contain two heald slide bars and healds arranged between them, linear drives in order to move the heald flames up and down, and coupling means in order to releasably connect the heald frames to the linear drives, wherein the linear drives at the two heald slide bars are arranged at fixed spatial positions in their longitudinal extent and at a distance from one another on the side of the heald slide bars remote from the healds; and in that the heald frames, the coupling means as well as the linear drives in each case are positioned together in groups, with the linear drives being arranged transversely to the longitudinal extent of the heald frames in a staggered fashion.

2. An arrangement in accordance with claim 1 wherein the groups are arranged with a spacing therebetween in a range from 0.20 m to 1.00 m.

3. An arrangement in accordance with claim 1 wherein the heald frames, the coupling means and the drive units are positioned identically.

4. An arrangement in accordance with claim 1 wherein the linear drives are arranged in a staggered fashion in like or in opposite orientation.

5. An arrangement in accordance with claim 1 wherein each group comprises at least two heald frames, two coupling means as well as two linear drives, with the linear drives in each case forming a drive unit.

6. An arrangement in accordance with claim 1 wherein the coupling means comprise a drive rod with a receiving section that is connectable to the heald frame.

7. An arrangement in accordance with claim 1 wherein at least one strut connects the heald slide bars to one another.

8. An arrangement in accordance with claim 1 wherein the drive rod is provided with at least one guide strip.

9. An arrangement in accordance with claim 1 wherein the outer surfaces of the coupling means are formed as guide surfaces.

10. An arrangement in accordance with claim 1 wherein the coupler has four linking points for the linear drives.

11. An arrangement in accordance with claim 1 wherein a plurality of groups of heald frames are arranged parallel to one another, with the distance between the heald frames of each group being substantially identical to the spacing of the heald frames within a group.

12. An arrangement in accordance with claim 1 further comprising a support apparatus for mounting the drive units.

13. An arrangement according to claim 2 wherein the groups are positioned with a spacing in a range from 0.40 m to 0.60 m.

14. A weaving machine with a pack of heald frames, the weaving machine including an arrangement for the formation of a shed, the arrangement comprising heald frames which are arranged parallel to and spaced with respect to one another and which contain two heald slide bars and healds arranged between them, linear drives in order to move the heald frames up and down, and coupling means in order to releasably connect the heald frames to the linear drives, wherein the linear drives at the two heald slide bars are arranged at fixed spatial positions in their longitudinal extent and at a distance from one another on the side of the heald slide bars remote from the healds; and in that the heald frames, the coupling means as well as the linear drives in each case are positioned together in groups, with the linear drives being arranged transversely to the longitudinal extent of the heald frames in a staggered fashion, wherein the weaving machine includes means for receiving a pack of frames.

* * * * *